US006354875B1

(12) United States Patent
Wu

(10) Patent No.: US 6,354,875 B1
(45) Date of Patent: Mar. 12, 2002

(54) ELECTRICAL CONNECTOR WITH A REAR SHIELD

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/686,438

(22) Filed: Oct. 10, 2000

(51) Int. Cl.[7] ..... H01R 13/73
(52) U.S. Cl. ..... 439/607; 439/108; 439/567
(58) Field of Search ..... 439/607–610, 439/101, 108, 95, 567, 571, 572

(56) References Cited

U.S. PATENT DOCUMENTS

| | | | | | |
|---|---|---|---|---|---|
| 5,921,811 | A | * | 7/1999 | Hsu | 439/567 |
| 5,947,767 | A | * | 2/2000 | Kitamura et al. | 439/567 |
| 6,019,616 | A | * | 2/2000 | Yagi et al. | 439/607 |
| 6,168,467 | B1 | * | 2/2000 | Chiou | 439/607 |
| 6,050,854 | A | * | 4/2000 | Fang et al. | 439/607 |
| 6,155,878 | A | * | 12/2000 | Chen | 439/108 |

* cited by examiner

*Primary Examiner*—Gary F. Paumen
(74) *Attorney, Agent, or Firm*—Wei Te Chung

(57) ABSTRACT

An electrical connector (1) comprises an insulative housing (2), a number of contacts (3) received in the housing, a pair of board locks (4) retained in the housing, and a shield (5) consisting of front and rear shields (50, 52) enclosing the housing for improved EMI protection. The housing comprises recesses (206) and a pair of partitions (26) each with a ledge (260) formed thereon. The rear shield has retaining tabs (542, 582) for being inserted into corresponding recesses, and a forwardly exposed slot (586) defined in each side wall (58) thereof for fittingly receiving a corresponding ledge. Each board lock comprises a front engaging portion (42) for mating with a corresponding ground contact of a complementary electrical connector, and a rear insertion portion (46) for being inserted into a printed circuit board. The rear shield further has a pair of downwardly extending pins (560) for being connected with grounding circuits of the printed circuit board, and spring tangs (584) for biasing against a side surface of the rear insertion portion of the board lock. A grounding path is thus established between the complementary electrical connector and the printed circuit board via the board locks, the spring tangs and the pins of the electrical connector.

1 Claim, 9 Drawing Sheets

ELECTRICAL CONNECTOR WITH A REAR SHIELD

BACKGROUND OF THE INVENTION

1. Field of the Invention

The present invention relates to a shielded electrical connector, and particularly to an SCA-2 connector having a rear shield that can be easily attached to and detached from an insulative housing of the connector when desired.

2. Description of Prior Art

SCA-2 (Single Connector Attachment) connectors provide a standard interface between SCSI (Small Computer System Interface) disk drives, Fiber Channel disk drives, GBIC (Gigabit Interface Converter) modules and backplane systems. The SCA-2 connectors conform to the SFF standard established by the Small Form Factor Committee, and can be classified into 3 types, i.e., 20-pin, 40-pin and 80-pin SCA-2 connectors. The 20-pin SCA-2 connectors are used with GBIC modules used as media interface modules for fiber channel; the 40-pin SCA-2 connectors are used with 3.5" Fiber Channel disk drives; and the 80-pin SCA-2 connectors are used with 3.5" SCSI disk drives.

With the ever-increasing requirement for high-speed signal transmission, shielding and grounding capabilities are becoming increasingly important for electrical connectors. Such shielding and grounding means are generally used for protection against EMI (Electromagnetic Interference) and ESD (Electrostatic Discharge). To assemble a shield to an insulative housing of the electrical connector, additional fastening devices, such as screws, nuts and pegs, are normally used, whereby the assembly and disassembly process of the shield is troublesome and manufacturing cost is also increased.

Additionally, one problem with a conventional SCA-2 connector is that contacts received in an insulative housing thereof are not completely shielded from EMI, since only front contact portions of the contacts are shielded, while rear tail portions are exposed.

Therefore, an additional rear shield for an SCA-2 connector which can be easily attached to and detach from the connector is required for overcoming the above disadvantages of the prior art.

SUMMARY OF THE INVENTION

Accordingly, one object of the present invention is to provide an SCA-2 connector having a rear shield to promote EMI-free signal transmissions in cooperation with an existing front shield.

Another object of the present invention is to provide an SCA-2 connector having a rear shield which can be easily attached to and detached from an insulative housing without additional fastening devices, thereby facilitating convenient assembly and disassembly of the rear shield and reducing manufacturing costs.

A further object of the present invention is to provide an SCA-2 connector having grounding mechanisms for establishing a grounding path between a complementary SCA-2 connector and a printed circuit board on which the SCA-2 connector is mounted.

In order to achieve the objects set forth, an SCA-2 connector in accordance with the present invention comprises an insulative housing, a plurality of contacts received in the housing, a pair of board locks retained in the housing, and a shield consisting of a front shield and a rear shield cooperatively enclosing the housing.

According to one aspect of the present invention, the front shield encloses front contact portions of the contacts, and the rear shield encloses rear right-angle bent tail portions of the contacts, whereby improved EMI shielding capabilities are provided.

According to a second aspect of the present invention, the housing comprises a plurality of recesses and a pair of partitions each with a ledge formed on an outer side surface thereof. The rear shield has forwardly projecting retaining tabs for being inserted into corresponding recesses of the housing to prevent rearward movement of the rear shield relative to the housing, and a forwardly exposed slot defined in each side wall thereof for fittingly receiving a corresponding ledge of the housing to prevent vertical and forward movements of the rear shield relative to the housing. Thus, the rear shield is retentively assembled to the housing, and assembly and disassembly of the rear shield are also facilitated since no additional fastening devices are required.

According to a third aspect of the present invention, each board lock comprises a front engaging portion for mating with a corresponding ground contact of a complementary SCA-2 connector, and a rear insertion portion for being inserted into a printed circuit board. The rear shield has a pair of pins downwardly extending from a partition thereof for being connected with grounding circuits of the printed circuit board, and a spring tang stamped from each side wall thereof for biasing against a side surface of the rear insertion portion of the board lock. A grounding path is thus established between the complementary SCA-2 connector and the printed circuit board via the board locks, the spring tangs and the pins of the SCA-2 connector.

Other objects, advantages and novel features of the invention will become more apparent from the following detailed description when taken in conjunction with the accompanying drawings.

DETAILED DESCRIPTION OF THE INVENTION

Figure 1:
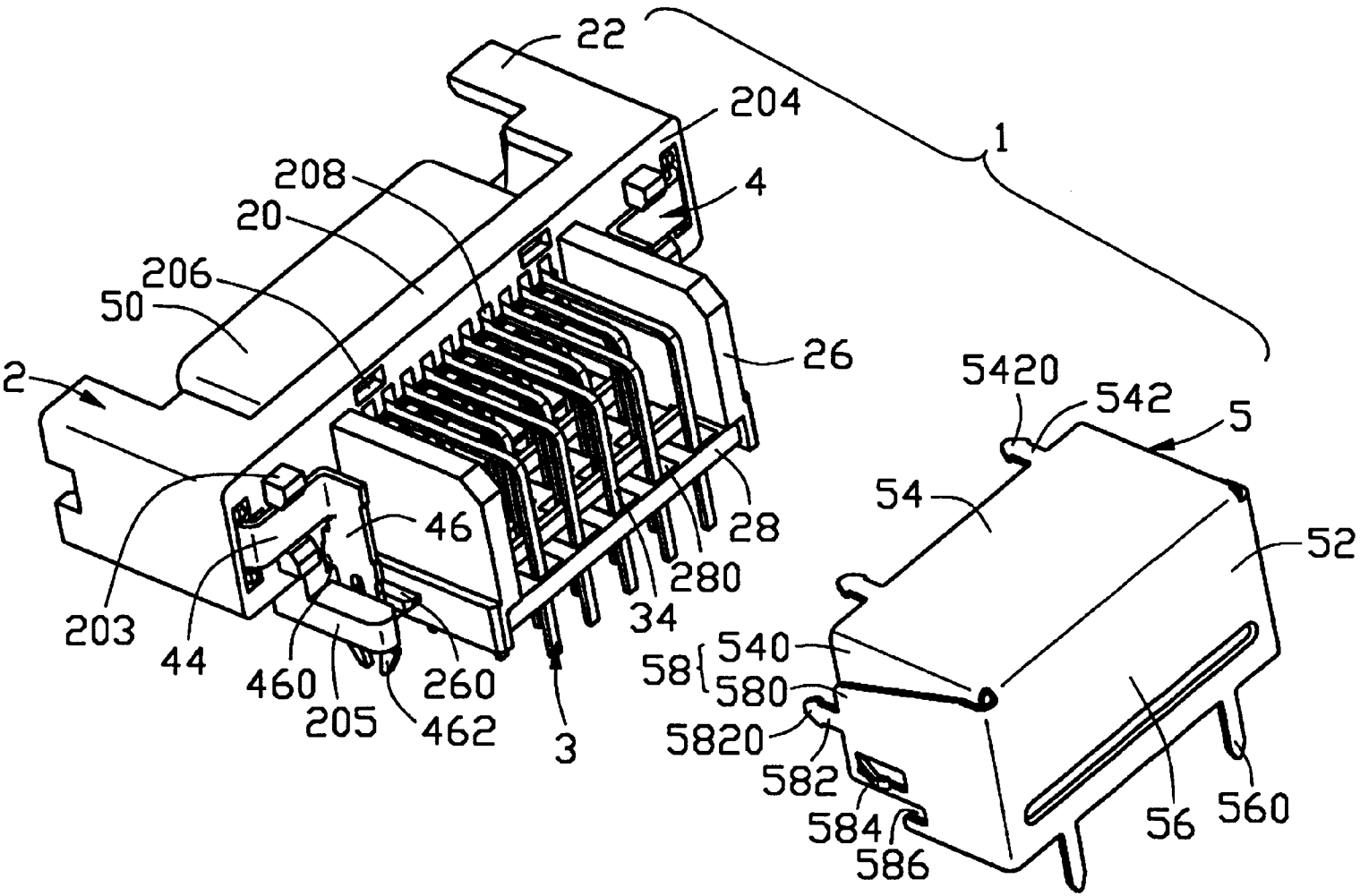
FIG. 1 is an exploded view of an SCA-2 connector of the present invention consisting of a connector subassembly and a rear shield.

Reference will now be made to the drawing figures to describe the present invention in detail.

Figure 2:
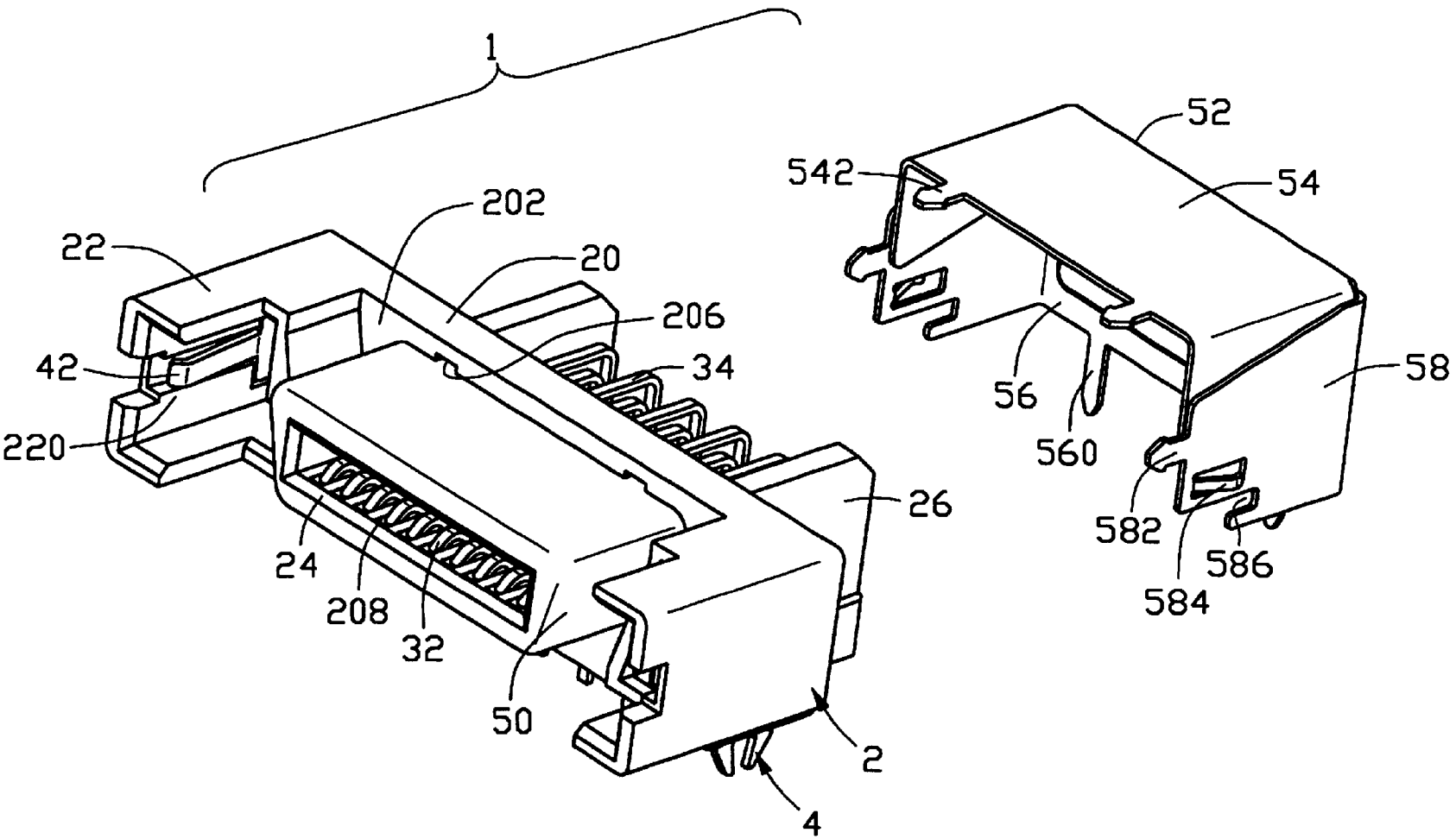
FIG. 2 is a view similar to FIG. 1 but viewed from a different angle.
Figure 3:
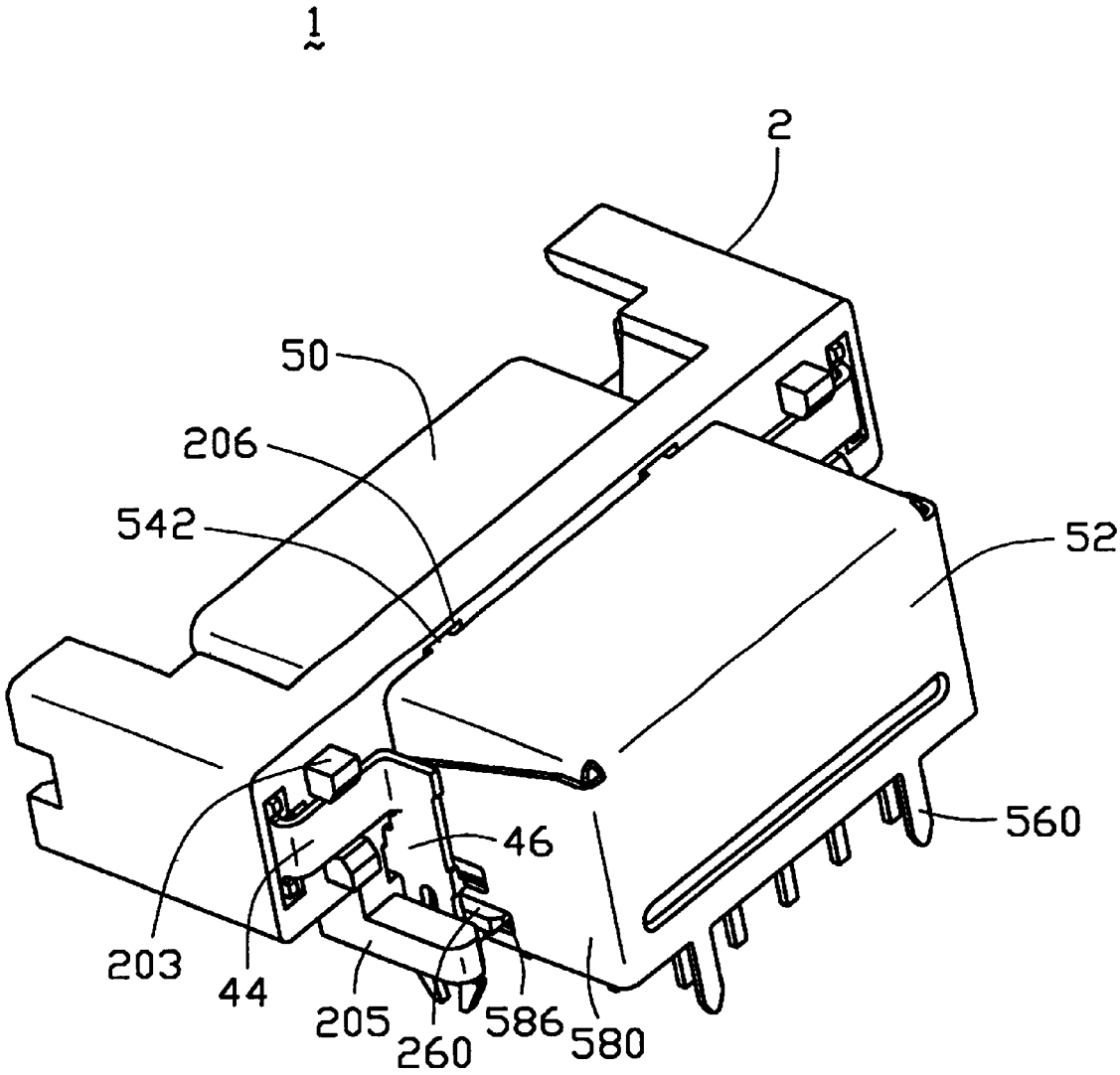
FIG. 3 is an assembled view of FIG. 1.

Referring to FIGS. 1 and 2, an SCA-2 connector 1 in accordance with the present invention comprises an insulative housing 2, a plurality of contacts 3 received in the housing 2, a pair of board locks 4 retained in the housing 2, and a shield 5 consisting of a front shield 50 and a rear shield 52 for EMI protection. In this embodiment, the SCA-2 connector 1 is a 20-pin SCA-2 connector used for a GBIC module.

Figure 5:
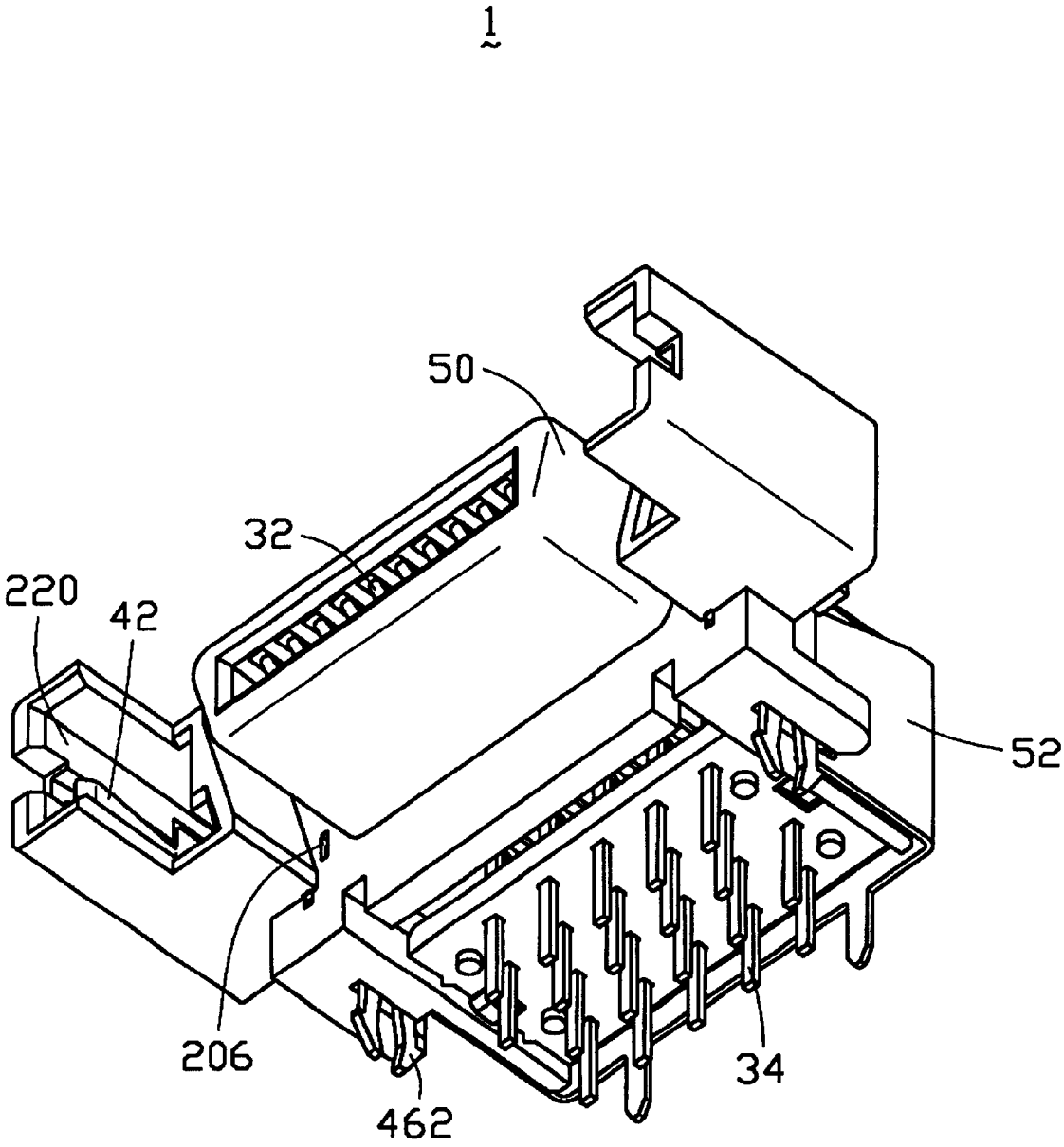
FIG. 5 is a bottom, perspective view of FIG. 3.
Figure 6:
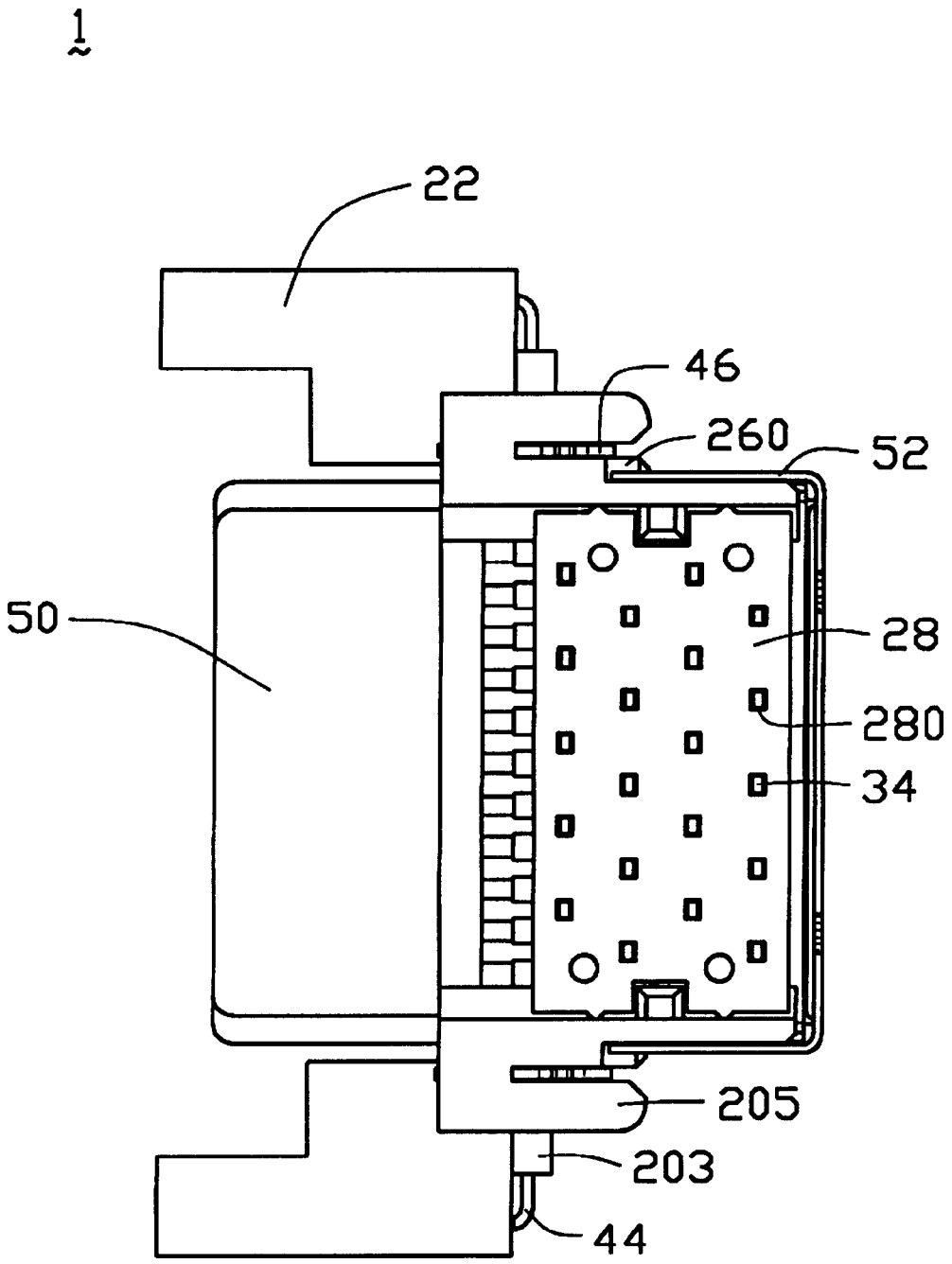
FIG. 6 is a plan view of FIG. 5.
Figure 7:
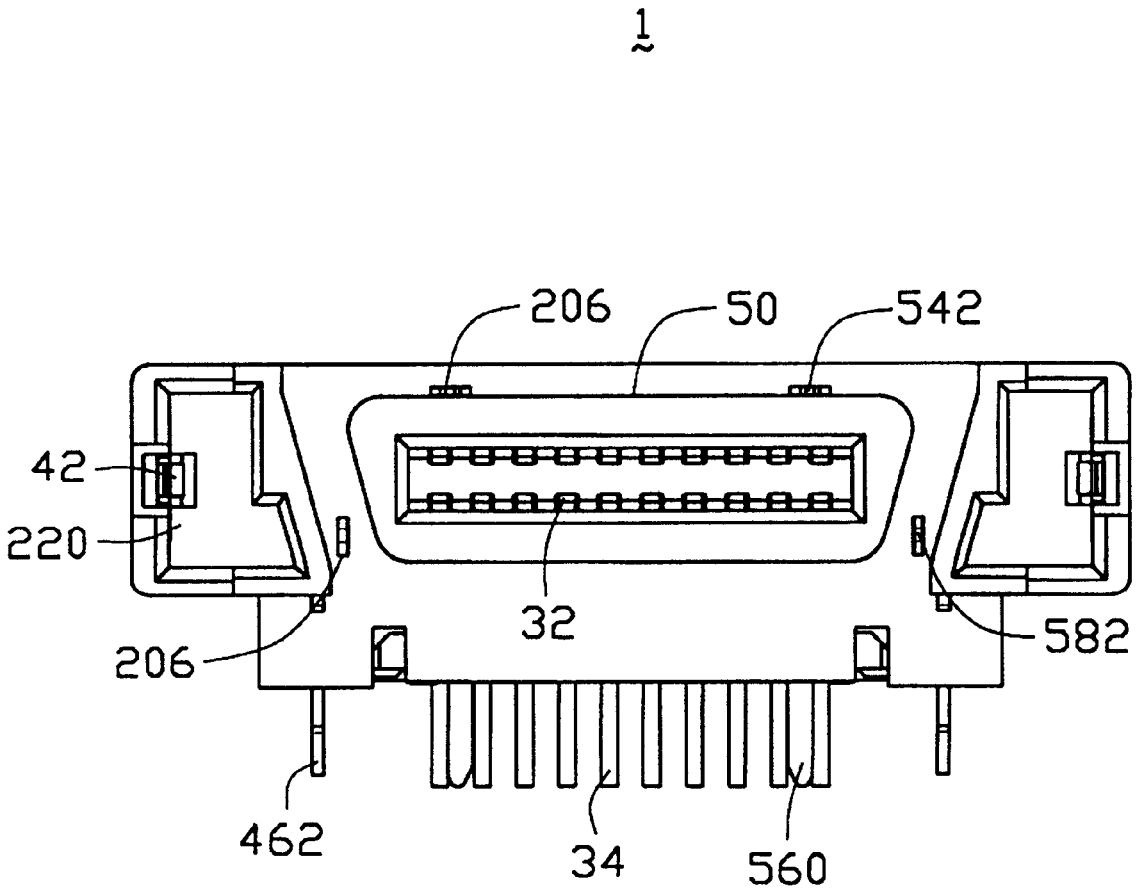
FIG. 7 is a front view of FIG. 3.
Figure 8:
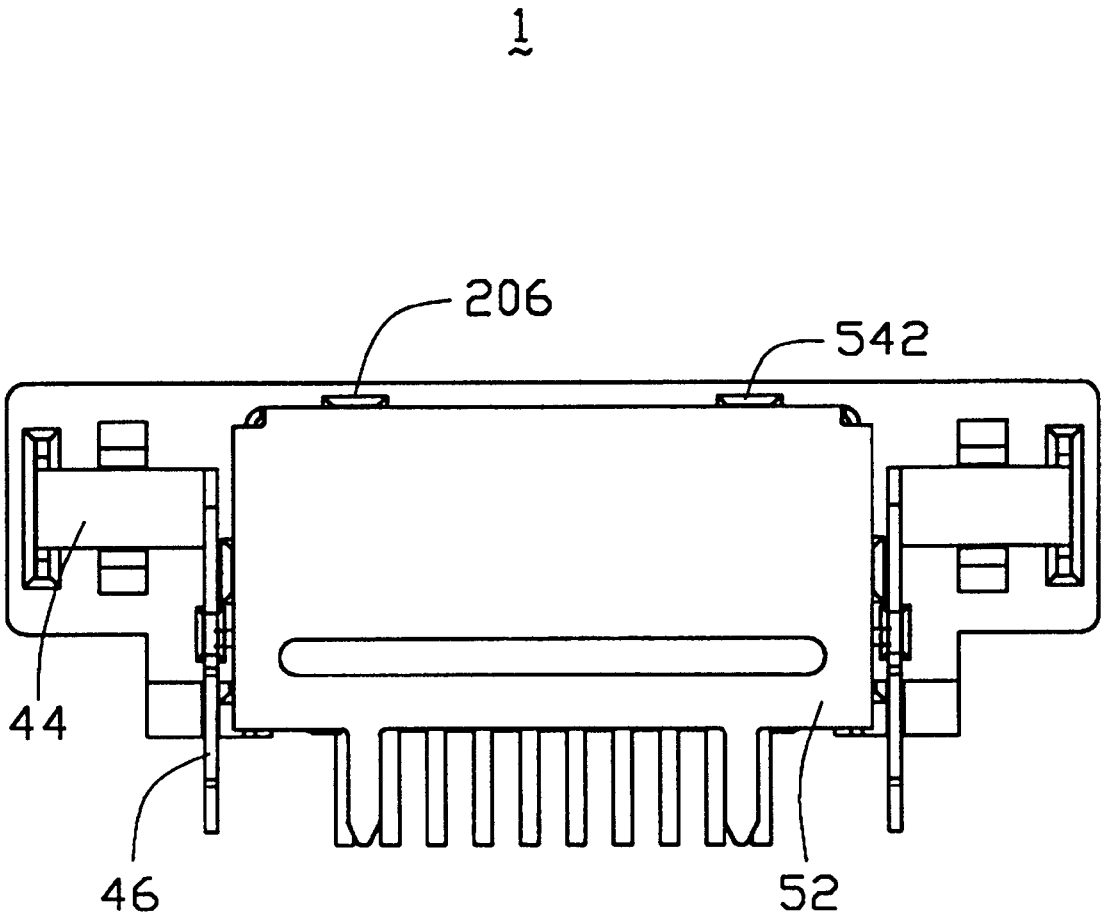
FIG. 8 is a rear view of FIG. 3.
Figure 9:
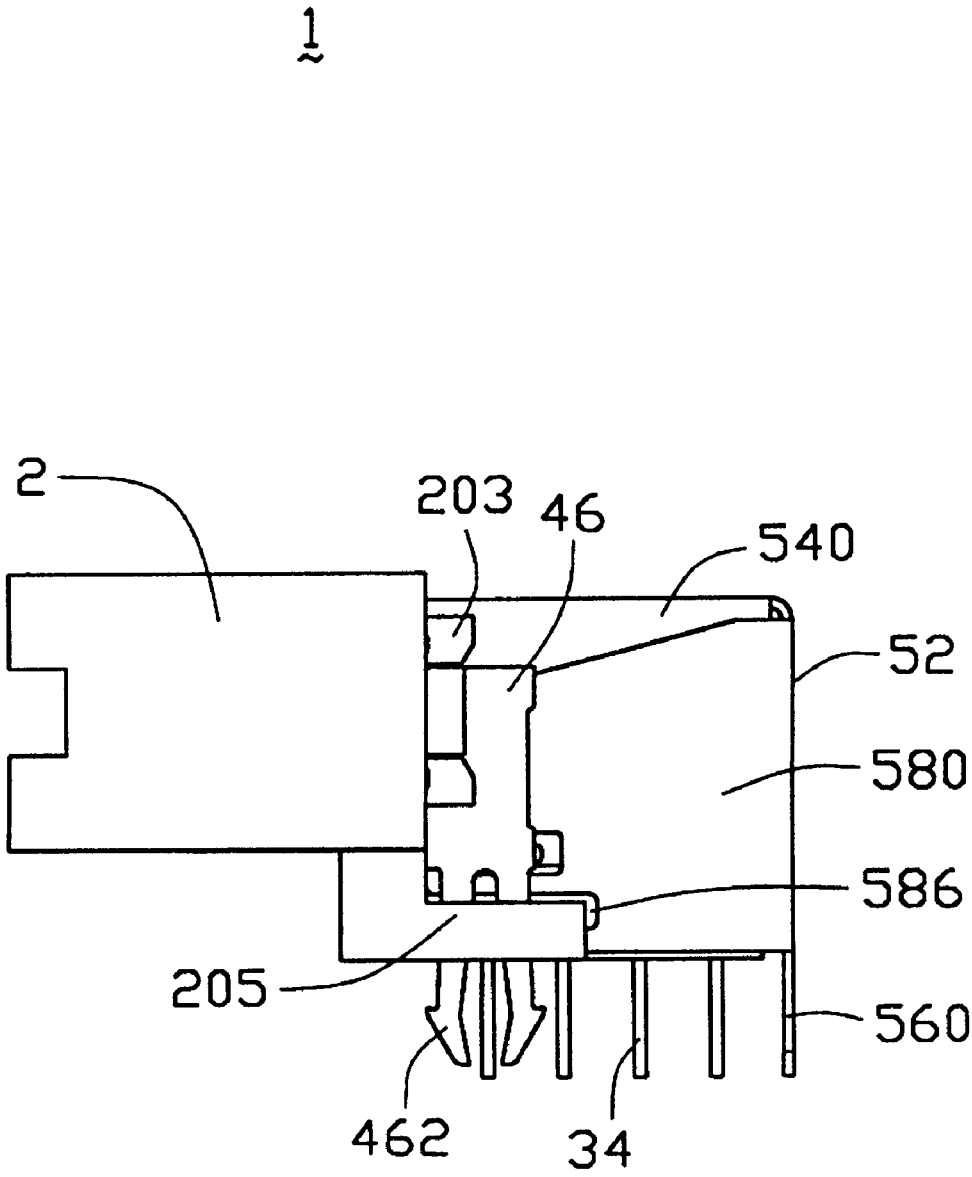
FIG. 9 is a side view of FIG. 3.

The insulative housing 2 comprises a body portion 20, a pair of side arms 22 forwardly extending from the body portion 20, a mating portion 24 projecting from a front surface 202 of the body portion 20 between the side arms 22, and a pair of partitions 26 extending rearward from a rear surface 204 of the body portion 20. A spacer 28 is retained between the pair of partitions 26 with a plurality of holes 280 defined in four rows in a staggered manner (best shown in FIGS. 5 and 6). Four recesses 206 (best shown in FIG. 7) are defined in the body portion 20 for engaging with the rear shield 52. A plurality of passageways 208 extends from the rear surface 204 of the body portion 20 to the mating portion 24. Each side arm 22 defines a receiving channel 220 therein for reception of a corresponding alignment post of a complementary SCA-2 connector (not shown) to ensure a blind mating connection.

A pair of vertically aligned protrusions 203 is formed on the rear surface 204 of the body portion 20 adjacent to each partition 26. A projection 205 extends rearward from a lower section of the body portion 20 between the protrusions 203 and the partition 26. A ledge 260 is formed on an outer side surface of each partition 26 facing a corresponding projection 205. The functions of the protrusions 203, the projections 205 and the ledges 260 will be provided hereinafter.

The contacts 3 are received in corresponding passageways 208 of the housing 2. Each contact 3 has a front curved contact portion 32 received in the mating portion 24, a retention portion (not shown) retained in the body portion 20, and a rear right-angle bent tail portion 34 extending through a corresponding hole 280 of the spacer 28 for connection with a PCB (Printed Circuit Board) (not shown) on which the SCA-2 connector 1 is mounted. The front contact portions 32 are adapted to mate with corresponding mating contacts (not shown) of the complementary SCA-2 connector to establish an electrical connection therebetween. The tail portions 34 are arranged in four rows in a staggered manner corresponding to the arrangement of the holes 280 of the spacer 28.

Each board lock 4 has a front engaging portion 42 engaged with the body portion 20 and forwardly extending into the receiving channel 220 of a corresponding side arm 22 for engaging with a corresponding ground contact (not shown) along the alignment post of the complementary SCA-2 connector. An intermediate portion 44 perpendicularly extends from the front engaging portion 42 and is retained between a corresponding pair of protrusions 203 for preventing upward and downward movements.

The board lock 4 further has a rear insertion portion 46 perpendicularly extending from the intermediate portion 44 and parallel with the partition 26 for being inserted into the PCB, whereby the SCA-2 connector 1 can be retained in position relative to the PCB before the contacts 3 are subjected to a soldering process. The rear insertion portion 46 has barbs 460 formed thereon for engaging with the body portion 20 of the housing 2, and a pair of spaced legs 462 at a free end thereof for being compressively inserted into corresponding through holes (not shown) in the PCB. The rear insertion portion 46 is sandwiched between the spaced projection 205 and the ledge 260 to further restrict lateral movements thereof.

The front shield 50 encloses the mating portion 24 of the housing 2 for protecting the front contact portions 32 of the contacts 3 from EMI. To promote EMI-free signal transmission, the rear shield 52 is further provided to shield the rear right-angle bent tail portions 34 of the contacts 3. The rear shield 52 comprises a top wall 54, a partition 56 downwardly depending from the top wall 54, and a pair of opposite side walls 58 each composed of a first side portion 540 downwardly extending from the top wall 54 and a second side portion 580 forwardly extending from the partition 56. The second side portion 580 overlaps the first side portion 540, whereby complete EMI shielding for the tail portions 34 of the contacts 3 is ensured since no open seams are left between the top wall 54 and the side wall 58.

Both the top wall 54 and the second side portion 580 of the side wall 58 are provided with respective retaining tabs 542, 582 at a front edge thereof for being inserted into corresponding recesses 206 of the housing 2. Each retaining tab 542, 582 has a chamfered, large-dimensioned free end portion 5420, 5820 for facilitating extension through corresponding recesses 206. Each second side portion 580 further comprises a rearwardly and outwardly extending spring tang 584 stamped therefrom, and a forwardly exposed slot 586 below the spring tang 584. The partition 56 has two downwardly extending pins 560 for connection with grounding circuits of the PCB.

Figure 4:
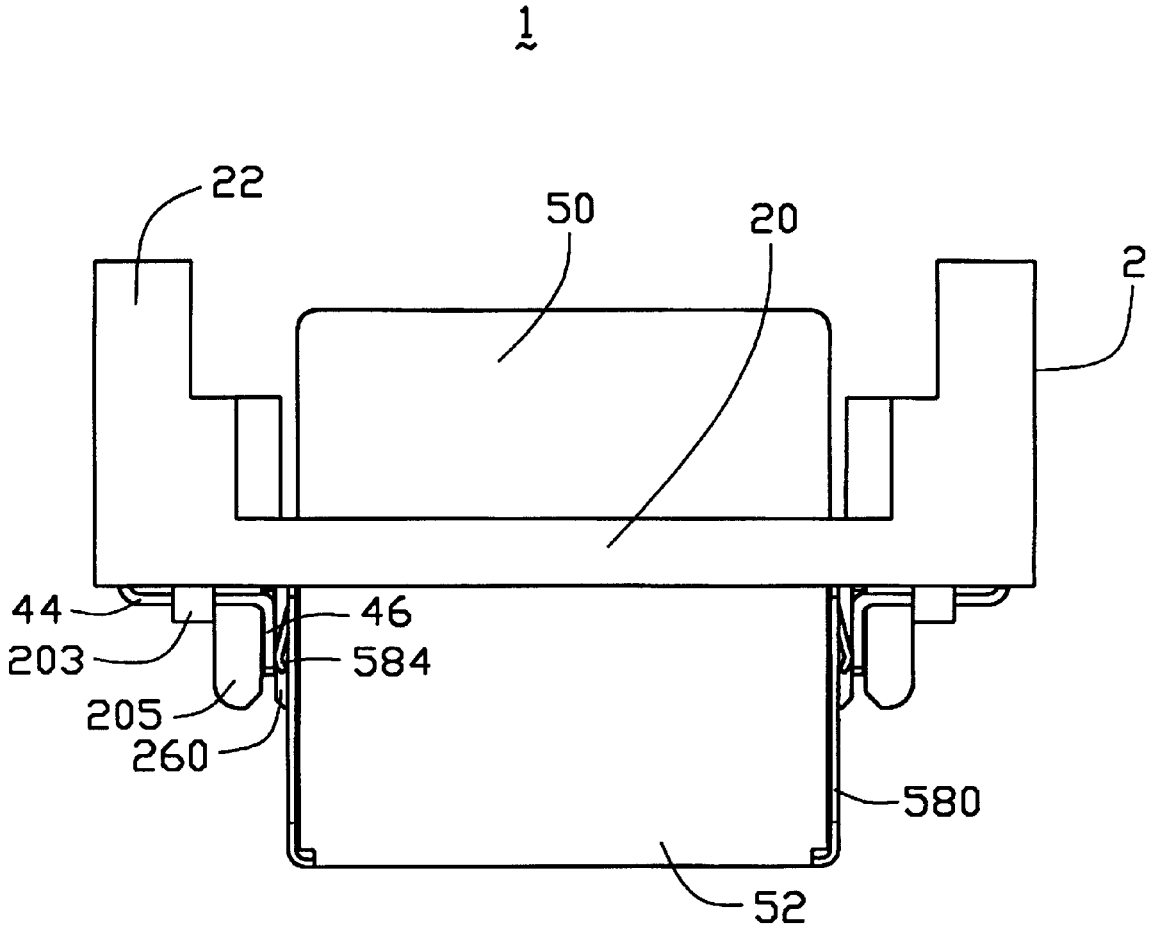
FIG. 4 is a plan, top view of FIG. 3.

Also referring to FIGS. 3–9, in assembly, the rear shield 52 is assembled to the housing 2 from the rear side. The slot 586 of the rear shield 52 fittingly receives a corresponding ledge 260 to prevent vertical and forward movements thereof. As is best shown in FIG. 4, the spring tang 584 biases against an inner side surface of the rear insertion portion 46 of the board lock 4 to establish an electrical connection therebetween. The retaining tabs 542 and 582 are inserted into corresponding recesses 206 of the housing 2 with rear edges of the free end portions 5420 and 5820 thereof abutting against the front surface 202 of the body portion 20, whereby rearward movement of the rear shield 52 is also prevented. Thus, the rear shield 52 is facilely and securely assembled to the housing 2 without requirement for additional fastening devices. The rear shield 52 also can be easily detached from the housing 2 when desired. Therefore, assembly and disassembly of the rear shield 52 are significantly facilitated, and shielding effectiveness is also significantly improved.

When the SCA-2 connector 1 connects with the complementary SCA-2 connector, since the front engaging portions 42 of the board locks 4 are longer than the contacts 3, the front engaging portions 42 of the board locks 4 engage with the corresponding ground contacts of the complementary SCA-2 connector before connection occurs between corresponding signal contacts. Similarly, when the SCA-2 connector 1 disconnects from the complementary SCA-2 connector, the front engaging portions 42 of the board locks 4 disengage from the corresponding ground contacts of the complementary SCA-2 connector after disconnection occurs between the corresponding signal contacts. Therefore, hot-plug capabilities are ensured. When the SCA-2 connectors are mated with each other, a grounding path is established between the ground contacts of the complementary SCA-2 connector and the PCB via the board locks 4, and also via the spring tangs 586 of the rear shield 5 which bias against the board locks 4, and thence to the pins 560 of the rear shield 52, which connect to grounding circuits of the PCB, whereby electrostatic charges are effectively discharged. In other words, the board lock 4 of the present invention also functions as a ground contact.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board and adapted for mating with a complementary electrical connector, comprising:

an insulative housing having a body portion, the body portion defining a plurality of passageways therein and having front and rear surfaces;

a plurality of contacts received in corresponding passageways;

a pair of ground contacts retained in the housing, each of the ground contacts having a front engaging portion projecting beyond the front surface of the body portion for mating with a corresponding ground contact of a complementary electrical connector and a rear portion projecting beyond the rear surface of the body portion; and a shield attached to the housing for shielding the contacts, the shield comprising a top wall, a pair of side walls and a pair of downwardly extending pins connected to grounding circuits of a printed circuit board on which the electrical connector is mounted, each of the side walls having a spring tang biasing against a side surface of the rear portion of a corresponding ground contact, whereby a grounding path is established between the complementary connector and the printed circuit board via the ground contacts, the spring tangs of the shield and the pins of the shield;

wherein the rear portion of the ground contact is contained in a plane perpendicular to the rear surface of the body portion of the housing;

wherein the spring tang of the shield is an outwardly and rearwardly stamped spring tang biasing against an inner side surface of the rear portion of the corresponding ground contact;

wherein the ground contact is a board lock, and the rear portion has a pair of spaced legs for being compressively inserted into the printed circuit board;

wherein the shield further comprises a partition downwardly extending from the top wall, and wherein the pins extend from the partition;

wherein each of the side walls of the shield is composed of a first side portion downwardly extending from the top wall and a second side portion forwardly extending from the partition and overlapping the first side portion, and wherein the spring tangs are stamped from the second side portion;

wherein the housing further comprises a pair of opposite side arms forwardly extending from the body portion, each side arm defining a receiving channel for receiving a corresponding ground contact of the complementary electrical connector, and wherein the front engaging portion of the ground contact is received in the receiving channel.

* * * * *